United States Patent [19]

Inoue et al.

[11] Patent Number: 4,535,048

[45] Date of Patent: Aug. 13, 1985

[54] TONER FOR DEVELOPMENT OF ELECTROSTATIC CHARGES

[75] Inventors: Sukejiro Inoue, Yokohama; Masumi Sasakawa, Tokyo; Hiroshi Fukumoto; Shinji Doi, both of Kawasaki, all of Japan

[73] Assignee: Canon Kabushiki Kaisha, Tokyo, Japan

[21] Appl. No.: 520,576

[22] Filed: Aug. 5, 1983

[30] Foreign Application Priority Data

Aug. 12, 1982 [JP] Japan ..... 57-140241

[51] Int. Cl.[3] ..... G03G 9/08; G03G 9/14

[52] U.S. Cl. ..... 430/110; 430/106.6

[58] Field of Search ..... 430/109, 110, 114, 115

[56] References Cited

U.S. PATENT DOCUMENTS

| | | | |
|---|---|---|---|
| 4,206,064 | 6/1980 | Kiuchi et al. | 430/110 X |
| 4,403,027 | 9/1983 | Ishikawa et al. | 430/110 |
| 4,404,271 | 9/1983 | Kawagishi et al. | 430/110 |

*Primary Examiner*—Roland E. Martin

*Attorney, Agent, or Firm*—Fitzpatrick, Cella, Harper & Scinto

[57] ABSTRACT

A toner for the development of electrostatic charges comprising an amorphous polyester having an acid value of from 10 to 100 prepared by the reaction of at least one etherified diphenol with an acid component, and a salicylic acid metal complex. The diphenol is propoxylated, or propoxylated and ethoxylated wherein the propyloxy group content is not less than 50 mole % of the propoxy and ethoxy groups, and the acid component contains up to 40 mole % of a trivalent or higher valent aromatic carboxylic acid.

9 Claims, No Drawings

TONER FOR DEVELOPMENT OF ELECTROSTATIC CHARGES

BACKGROUND OF THE INVENTION

1. Field of the Invention

This invention relates to a toner to be used for elecrophotography, electrostatic printing and, in particular to a toner suitable for the heat fixing method.

2. Description of the Prior Art

In the prior art, there have been known a number of electrophotographic methods as disclosed in U.S. Pat. No. 2,297,691, Japanese patent publication No. 23,910/1967 and Japanese patent publication No. 24,748/1968. In general, photoconductive substances are utilized, and electrical latent images are formed on a photosensitive member by various means. The development of said images is effected by use of a toner, and after optionally carrying out transfer of the toner images to transfer materials such as paper, the images are fixed by heating or pressing to obtain copied products.

Various developing methods have been known, in which electrical latent images are visualized by use of a toner.

For example, there have been known a large number of developing methods such as the magnetic brush method disclosed in U.S. Pat. No. 2,874,063; the cascade developing method disclosed in U.S. Pat. No. 2,618,552; the powder cloud method and the fur brush method disclosed in U.S. Pat. No. 2,221,776; the liquid developing method; and so on.

As the toner for these developing methods, there have been employed fine powders having dispersed dyes or pigments in natural or synthetic resins. Further, it is also known to use fine developing powders in which third substances have been added for various purposes.

The developed toner images are fixed, after being transferred onto transfer materials such as paper, if necessary.

As methods for fixing toner images, there is the method in which the toner is melted under heating by means of a heater or a hot roller; the method in which a binder resin in the toner is softened or dissolved by an organic solvent to be fixed onto a support; and the method in which the toner is fixed onto the support by pressing.

Toners are prepared from materials selected to be suitable for the respective fixing methods, and a toner to be used for a specific fixing method cannot generally be used for other fixing methods. In particular, it is almost impossible to use a toner to be used for the heat fusion fixing method in the hot roller fixing method, the solvent fixing method or the pressure fixing method. Accordingly, toners have been studied and developed to be suited for the respective fixing methods.

There have been also known various magnetic recording methods, in which magnetic latent images are formed and developed with magnetic toners.

Concerning the step of fixing toner images onto papers or other materials, various methods and devices have been developed. The most common method presently available is the so called hot roll fixing system which applies heat and pressure at the same time. In this system an image receiving sheet carrying toner images is brought into contact with heated rollers to have the toner images fixed onto the image receiving sheet. However, when such a fixing system is utilized, the toner of the prior art suffers from troubles such as the so called off-set. Off-set is an unfavorable phenomenon in which a part of the toner carried on the image receiving sheet is transferred onto the roller surface.

As described in Japanese patent publication No. 23,354/1976, such an off-set phenomenon, particularly hot off-set, is likely to occur when a low molecular weight resin is used. Therefore, as also described in said Patent Publication, off-set phenomena may be prevented to some extent by use of a crosslinked resin. However, as a matter of course, by utilizing merely a crosslinked resin, the fixing temperature is elevated, whereby unfixed portions may be formed under ordinary fixing conditions, thus resulting in the problem of low temperature off-set at unfixed portions.

The rollers that contact with the toner images are formed at least at their surface layers of silicone rubber or fluorine containing resin having good releasability. Alternatively, there is also a system in which a release oil such as silicone oil is applied on the roller surfaces to prevent off-set as well as to prevent fatigue of the roller surfaces. However, in the system, in which an oil is applied, there are problems such as the fixing device becoming complicated by the provision of an oil applying system, and also an unpleasant feeling is given to users by the vaporization of the oil. Therefore, prevention of off-set by oil coating is not preferable. Under the present invention, however, a toner having good off-set resistance with a broad fixing temperature region has been developed. Also, as a matter of course, toners are required to be excellent in their anti-blocking property, developing characteristic, transfer characteristic, cleaning characteristic, etc. in addition to their fixing characteristic. Nevertheless, the toners of the prior art possess one or more of the defects mentioned below. That is, most of the toners which can be easily melted by heating are likely to cake or agglomerate in a copying machine. Most of the toners tend to deteriorate in their triboelectric characteristics and free flowing property due to moisture in the environment. Also, in most toners, image densities obtained change, or the background densities increase to lower the quality of the copied products because of mutual deteriorations of toner particles, carrier particles and the photosensitive plate resulting from collision between the toner particles and carrier particles and the contact thereof with the surface of the photosensitive plate during repeated developments and continuous usage. Accordingly, it has been desired to have a toner which is excellent in various toner characteristics and suitable for use in the hot roller fixing method.

Further, in recent years, for more efficient copying operations, high speed fixing has been becoming popular. There is an attempt to lower the softening point of a binder resin in the toner to thereby effect easy heat fixing, for the purpose of increasing the fixing speed in the heat fixing system of the prior art. But; lowering of the softening point will cause troubles such as the occurrence of agglomeration or blocking of toner particles during usage. Thus, it has been strongly desired to have a toner which is suitable for higher speed hot roller fixing, which is also excellent in toner characteristics and which does not cause roller off-set and agglomeration or blocking of the toner particles.

We have made studies and researches on the materials which are good in hot roll high speed fixing characteristic and also excellent in off-set resistance. Consequently we found that polyester resins satisfy such requirements to a considerable extent. Further, among polyester resins, amorphous resins having network structures were found to be preferable in off-set resistance. However, even such polyesters have many problems with respect to high speed fixing characteristic, off-set resistance, image characteristics at high humidity, etc. As the result of extensive efforts, it has been found that a combination of a specific polyester with a crosslinking agent can satisfy significantly the above characteristics. The present invention has been accomplished based on such a finding.

SUMMARY OF THE INVENTION

An object of the present invention is to provide a toner for hot roller fixing which overcomes the problems described above.

Another object of the present invention is to provide a toner for hot roller fixing, that has particularly good fixing characteristic and good off-set resistance.

A further object of the present invention is to provide a toner for hot roller fixing, which has good charging characteristic, exhibits constantly stable charging characteristics during usage and is capable of giving clear images without fog.

Still another object of the present invention is to provide a toner for hot roller fixing, which is excellent in free-flow property and also excellent in impact resistance without causing agglomeration.

Still another object of the present invention is to provide a toner for hot roller fixing, which gives little amount of adherent materials onto the toner holding member or the photosensitive material surface.

Still another object of the present invention is to provide a magnetic toner, which exhibits good and uniform magnetic property and is capable of hot roller fixing, when made into a magnetic developer.

According to an aspect of the present invention, there is provided a toner for the development of electrostatic charges, comprising an amorphous polyester having an acid value of from 10 to 100 prepared by the reaction of at least one etherified diphenol with at least one phtalic acid, and a salicylic acid metal complex. The diphenol is propoxylated, or propoxylated and ethoxylated and the propoxy group content is not less than 50 mole% of the propoxy and ethoxy groups, and the phthalic acids contain up to 40 mole% of a trivalent or higher valent aromatic carboxylic acid.

DETAILED DESCRIPTION OF THE PREFERRED EMBODIMENTS

The polyester resin used in the present invention is preferably a polyester resin of a specific kind suited for the objects of the present invention. That is, the polyester of the present invention comprises an acid component and an alcoholic component. The acid component is primarily constituted of an aromatic dicarboxylic acid, typically at least one phthalic acid and a small quantity of an aromatic polycarboxylic acid. The alcoholic component is primarily constituted of a mixture of etherified diphenols. And, further, said etherified diphenols are mainly composed of propoxylated isopropylidenediphenol partially mixed with ethoxylated isopropylidenediphenol.

Introduction of aromatic groups into a polyester are of great advantage to the generation of triboelectric charges, the ability of maintaining the charge on insulating electrophotographic toners, similar to that known in the art in vinyl type polymers, etc., and also the thermal characteristics during fixing. And, formation of an amorphous network structure by introduction of aromatic polycarboxylic acids is a great element for utilization of the polyester as a low melting blocking-free binder for toner.

As a phthalic acid to be used in the polyester of the present invention, there is included phthalic acid, isophthalic acid, phthalic acid anhydride, terephthalic acid and derivatives thereof such as esters. Examples of a trivalent or higher aromatic polycarboxylic acid is 1,2,4-benzene tricarboxylic acid, 1,2,5-benzene tricarboxylic acid, 1,2,4-naphthalene tricarboxylic acid, 2,5,7-naphthalene tricarboxylic acid, 1,2,4,5-benzene tetracarboxylic acid or anhydrides or esters thereof. The amount of the trivalent or higher valent polycarboxylic acid should preferably not exceed 40 mole% of the acid component. A toner for the development of electrostatic charges, comprising a salicylic acid metal complex and an amorphous polyester having an acid value of from 10 to 100 prepared by the reaction of (1) at least one etherified diphenol with (2) an acid component, said diphenol being propoxylated, or propoxylated and ethoxylated wherein the propoxy group content is not less than 50 mole % of the total of the propoxy and ethoxy groups, said acid component comprising (a) at least one phthalic acid or a reactive derivative thereof and (b) at least one trivalent or higher valent aromatic carboxylic acid wherein (b) is in an amount of not more than 40 mole % based on the total amount of said acid component.

The etherified diphenol to be used in the present invention is primarily an etherified isopropylidenediphenol obtained by etherification of an isopropylidenediphenol, particularly propoxylated and/or ethoxylated isopropylidenediphenol. These have 2 to 3 moles of oxypropylene groups per mole of isopropylidenediphenol. Typical examples include polyoxypropylene-2,2-bis(4-hydroxyphenyl)-propane, polyoxypropylene-2,2-bis(4-hydroxy, 2,6-dichlorophenyl)propane, polyoxyethylene(1.0)-polyoxypropylene (1.5)-bis(4-hydroxyphenyl)propane and the like.

Particularly useful in the present invention are propoxylated isopropylidenediphenols containing no ethoxylated isopropylidenediphenols, or if any, preferably in a molar amount not exceeding that of the propoxylated isopropylidenediphenol. Also, in the case of an isopropylidenediphenol having propoxylation and ethoxylation, the level of ethoxylation should preferably not exceed that of propoxylation. Namely, in a toner composition utilizing a polyester in which the etherified diphenol is composed of a majority of ethoxylated isopropylidenediphenol, its characteristics under high humidity are clearly inferior to a toner composition using a propoxylated isopropylidenediphenol. This is believed to reflect the difference in hydrophilicity, or hygroscopicity of the toner compositions obtained. That is, a toner composition using etherified isopropylidenediphenol in excess of the ethoxylated isopropylidenediphenol has higher hygroscopicity under high humidity, and therefore lower triboelectrifying characteristics, resulting in inferior developing performance and leading consequently to lower image density.

The aforesaid etherified diphenol can be obtained by adding directly ethylene oxide or propylene oxide to a diphenol or by the reaction of an olefin halohydrin with a diphenol.

As the constituent of the polyester resin of the present invention, there may be used general components conventionally used in the art in addition to the acid component and the alcoholic component as described above, within a range which does not interfere with the objects of the present invention. For example, as acid components, there may be employed aliphatic carboxylic acids such as maleic acid, fumaric acid, succinic acid, adipic acid, sebacic acid and the like; and alicyclic carboxylic acids such as hexahydrophthalic acid, 1,3-cyclohexane dicarboxylic acid and the like. As alcoholic components, there may be employed aliphatic polyols such as ethyleneglycol, propyleneglycol, 1,4-butanediol, 1,5-pentanediol, 1,6-hexanediol, glycerine, trimethylol ethane, trimethlol propane, pentaerythritol and the like; and alicyclic polyols such as 1,4-cyclohexanediol, 1,4-cyclohexane dimethanol and the like.

The polyester to be used in the present invention is desired to have a glass transition temperature of 60° C. or lower, and a softening point of 60° to 130° C. If the glass transition temperature exceeds 60° C. or the softening point exceeds 130° C., an excessively large amount of heat energy is required during heat fixing thereby lessening the high speed heat fixing characteristic. And, with a softening point lower than 60° C., the anti-offset characteristic during fixing becomes worse. In terms of its molecular weight, the number average molecular weight should be 2,000 to 20,000, preferably 3,000 to 10,000. With a molecular weight lower than 2,000, releasability of the toner from hot fixing rollers is lowered causing off-set phenomenon, while a molecular weight higher than 20,000 will result in a decreased heat fixing ability accompanied by elevation of the softening point.

The thermal characteristics of the above polyester are attributable to the aromaticity, the network structure and the molecular weight distribution which are characteristics of the polyester resin of the present invention, and they depend largely on the appropriate amount of trivalent or higher valent polycarboxylic acid to be formulated and the reaction conditions during synthesis of the polyester.

The polyester of the present invention has an acid value of 10 to 100, preferably 10 to 60. With an acid value of less than 10, the toner obtained is unsatisfactory with respect to off-set during heat fixing and has decreased releasability from fixing rollers. On the contrary, if it exceeds 100, the toner becomes worse in fixing characteristic or becomes susceptible giving humidity to deteriorated images under high humidity.

As the binder for the toner of the present invention, other known binder resins can be used in combination with the binder of the present invention, within the range which does not interfere with the performance of the present invention. For example, there may be employed polyester resins other than those of the present invention, epoxy resins, styreneacrylic resins, butyral resins, styrene-butadiene resins, etc.

The metal complex salt of salicylic acids, which is an important element together with the polyester resin of the toner of the present invention, is the essential component in combination with the aforesaid polyester that yields excellent fixing characteristic through its crosslinking effect. The metal ions from the salicylic acid-metal complex are bonded to the carboxylic groups in the polyester to bring about crosslinking in the polyester chains, thereby improving the melt viscosity characteristic and improving markedly the off-set onto fixing rollers.

The salicylic acid-metal complex to be used with the aforesaid polyester is a reaction product of salicylic acid or its derivative with a metal salt, capable of reacting with the carboxylic groups in the polyester. For example, there may be included zinc salicylate, chromium salicylate, manganese salicylate, nickel salicylate, cobalt salicylate, cobalt tert-butyl salicylate, chromium 3,5-di-tert-butyl salicylate, nickel 3,5-di-tert-butyl salicylate and the like.

In the present invention, the amount of the salicylic acid-metal complex is preferably 0.2 to 4% by weight based on the polyester. At a level less than 0.2%, the thermal reaction will be insufficient making releasability of the toner from the hot rolls worse, thereby causing readily off-set phenomenon.

The toner of the present invention may also contain charge controllers, colorants, and free-flow property modifiers if desired. Charge controllers or free-flow property modifiers can be used as a mixture with the toner (external addition). As the charge controllers, there are metal containing dyes, nigrosine, etc. The colorants may be available dyes and pigments well known in the art. Free-flow property modifiers may include colloidal silica and fatty acid metal salts.

When it is desired to obtain a magnetic toner, fine magnetic particles may be added into the toner. The magnetic material may be a material exhibiting magnetic property or a material which is magnetizable, including those known in the art as magnetic materials as exemplified by fine metal powders such as of iron, manganese, nickel, cobalt, chromium, etc., various ferrites, alloys or compounds of manganese, other strongly magnetic alloys such as magnetite, etc.

Further, for making more complete releasability of the toner from the hot fixing rollers, polyolefins such as low molecular weight polyethylene, low molecular weight polypropylene, etc. may also be added to the toner.

[PREPARATION EXAMPLE 1]

Into a four-necked flask were charged 545 parts of polyoxypropylene(2.5)-2,2-bis(4-hydroxyphenyl)propane, which is a propylene oxide adduct of 2,2-bis (4-hydroxyphenyl) propane, followed by setting a stirrer, a condenser, a thermometer and a gas introducing pipe on the flask, which is then placed in a mantle heater. After the reaction vessel was purged with nitrogen gas, the contents were heated to a temperature of 50° to 60° C., whereupon 90 parts of terephthalic acid, 45 parts of isophthalic acid and 76 parts of trimellitic acid were added so as to control the carboxylic groups to 0.9 equivalent per an equivalent of hydroxyl groups. This mixture system was heated under stirring at 210° C. After elapse of 5 hours of the reaction while removing the reaction water, the reaction was monitored by measuring the acid value every hour in order to find the end point of the reaction. The reaction mixture was cooled to room temperature on reaching an acid value of about 25.

[PREPARATION EXAMPLE 2]

According to the same procedure as in Preparation example 1, 520 parts of polyoxyethylene (1.0)-polyoxypropylene(1.5)-2,2-bis(4-hydroxyphenyl)propane and 3 parts of glycerine were charged into a flask, followed by purge with nitrogen and heating to 50° C. To this mixture were added 118 parts of terephthalic acid, 39 parts of isophthalic acid and 57 parts of trimellitic acid, and the mixture was heated under stirring at 210° C. After completion of the reaction, the reaction mixture was cooled to room temperature.

[PREPARATION EXAMPLE 3]

According to the same procedure as in Preparation example 1, 517 parts of polyoxypropylene(2.2)-2,2-bis(4-hydroxyphenyl)propane and 1.5 parts of ethyleneglycol were charged into a flask, followed by replacement with nitrogen and heating to 50° C. To this mixture were added 60 parts of terephthalic acid, 30 parts of isophthalic acid and 85 parts of trimellitic acid, and the mixture was reacted under stirring at 210° C. After completion of the reaction, the reaction mixture was cooled to room temperature.

[PREPARATION EXAMPLE 4]

The reaction product was obtained by carrying out the synthesis in the same manner as in Preparation example 1, except that 545 parts of the propylene oxide adduct of Preparation example 1 were replaced with 528 parts of polyoxyethylene(2.2)-2,2-bis(4-hydroxyphenyl)propane, which was an ethylene oxide adduct.

[EXAMPLE 1]

A mixture of 100 parts of the polyester of Preparation example 1, 65 parts of magnetic powders (Magnetite EPT-1000, produced by Toda Kogyo Co.), 5 parts of a low molecular weight polypropylene (Viscol 660 P, produced by Sanyo Kasei Kogyo Co.) and 2 parts of chromium 3,5-di-t-butylsalicylate was kneaded by heating on a roll. After the mixture was left to cool, it was crushed into coarse powders, which were further micropulverized by a ultrasonic jet mill, followed by classification by means of a pneumatic classifier, to obtain toner particles with a mean size of about 13μ. To the toner was added colloidal silica (Aerosil R-972 supplied by Nippon Aerosil Co., Ltd.) and the mixture was supplied to an electrophotographic copying device (NP-400 RE produced by Canon K.K.) to carry out a copying test. As the result, sufficient image density and development durability could be obtained, without any problem in fixing. For the purpose of further examination of the heat fixing characteristic, only the fixing section of the above copying device was provided, and the unfixed images made separately on a transfer paper were subjected to a fixing test by using this fixing device at various roller setting temperatures. As the result, no off-set phenomenon occurred over a wide temperature range, and the fixing characteristic was also excellent. Further, when this toner was left to stand in an atmosphere of 50° C., no blocking or caking was observed. There was also no problem in developing characteristics both under high humidity atmosphere and under low humidity atmosphere.

[EXAMPLE 2]

A toner was prepared according to the same procedure as in Example 1 except that the polyester in Example 1 was replaced with that of Preparation example 2 and the metal complex was changed to zinc 3,5-di-t-butylsalicylate. The same tests as in Example 1 were conducted for the toner obtained. As the result, it exhibited sufficient performances in all image characteristics, fixing characteristic and storage characteristic.

[EXAMPLE 3]

A mixture of 100 parts of the polyester of Preparation example 3, 60 parts of magnetic powders (Magnetite EPT-500, produced by Toda Kogyo Co.), 4 parts of a low molecular weight polyethylene (Highwax 220 P, produced by Mitsui Sekiyu Kagaku Co.) and 1 part of chromium 3,5-di-t-butylsalicylate was kneaded by heating on a roll. The resultant mixture was coarsely crushed, micropulverized and classified to obtain toner particles of 5 to 20μ. This toner was admixed with colloidal silica and subjected to the same copying test as in Example 1, whereby good performance was confirmed. There was also no problem in the fixing test by means of the external fixing device and in the test of standing at a high temperature of 50° C.

[EXAMPLE 4]

A mixture of 100 parts of the polyester of Preparation example 1, 8 parts of carbon black (Regal 400 R, produced by Cabot Co.), 4 parts of a low molecular weight polyethylene (Viscol 660P, produced by Sanyo Kasei Co.) and 1 part of chromium 3,5-ditert-butylsalicylate was kneaded by heating on a roll. The resultant mixture was coarsely crushed and micropulverized into a toner. Then, 15 parts of this toner were mixed with 85 parts of carrier iron powders (EFV 200/300, produced by Nippon Teppun K.K.) and the mixture was supplied to a copying machine NP-6000 produced by Canon K.K. to carry out developing tests. As the result, the initial image and the 5000th image at repeated copying were satisfactory, without any problem in fixing characteristic. As to dependency on the fixing temperature by means of the separately provided fixing device and storage test, sufficient performances could be confirmed.

[COMPARATIVE EXAMPLE 1]

Following the same procedure as in Example 1, except for using the polyester of Preparation example 4 as the polyester, a toner was obtained. This toner was added to colloidal silica, and the tests were conducted similarly as in Example 1, whereby sufficient performance could be exhibited with respect to all initial developing characteristics, fixing characteristic and storage characteristic. However, the developing characteristic under high humidity was found to be clearly lowered. That is, the image density was low, the image quality bad and humidity resistance inferior.

[COMPARATIVE EXAMPLE 2]

A mixture of 100 parts of the polyester of Preparation example 3, 60 parts of magnetic powders (EPT-1000) and 4 parts of a low molecular weight polypropylene (Viscol 660P) was kneaded on hot rolls and made into a toner according to the same procedure as described in Example 1. To the toner obtained was added colloidal silica and the mixture was subjected to the copying test. When the same tests as in Example 1 were conducted, the toner of this example gave rise to a marked problem particularly in fixing characteristic. Shortly speaking, high temperature off-set is liable to occur during fixing, and clearly the melt viscosity characteristic was found to be bad.

What is claimed is:

1. A toner for the development of electrostatic charges, comprising a salicylic acid metal complex and an amorphous polyester having an acid value of from 10 to 100 prepared by the reaction of (1) at least one etherified diphenol with (2) an acid component, said diphenol being propoxylated, or propoxylated and ethoxylated wherein the propoxy group content is not less than 50 mole % of the total of the propoxy and ethoxy groups, said acid component comprising (a) at least one phthalic acid or a reactive derivative thereof and (b) at least one trivalent or higher valent aromatic carboxylic acid wherein (b) is in an amount of not more than 40 mole % based on the total amount of said acid component, and wherein the amount of the salicylic acid metal complex is at least 0.2% by weight based on the polyester.

2. A toner for the development of electrostatic charges according to claim 1, wherein the phthalic acid is selected from the group consisting of phthalic acid, isophthalic acid, phthalic acid anhydride, terephthalic acid and derivatives thereof.

3. A toner for the development of electrostatic charges according to claim 1, wherein the trivalent or higher valent aromatic polycarboxylic acid is selected from the group consisting of 1,2,4-benzene tricarboxylic acid, 1,2,5-benzene tricarboxylic acid, 1,2,4-naphthalene tricarboxylic acid, 2,5,7-naphthalene tricarboxylic acid, 1,2,4,5-benzene tetracarboxylic acid, and anhydrides or esters thereof.

4. A toner for development of electrostatic charges according to claim 1 wherein said etherified diphenol is propoxylated and/or ethoxylated isopropylidenediphenol having for each mole of said diphenol 2 to 3 moles of oxypropylene or oxyethylene group selected from the group consisting of polyoxypropylene-2,2-bis(4-hydroxyphenyl) propane, polyoxypropylene-2,2-bis(4-hydroxy-2,6-dichlorophenyl)propane, and polyoxyethylene(1.0)-polyoxypropylene(1.5)bis(4-hydroxyphenyl)propane.

5. A toner for the development of electrostatic charges according to claim 1, wherein said polyester has a glass transition temperature of 60° C. or lower, and a softening point of 60° C. to 130° C.

6. A toner for the development of electrostatic charges according to claim 1, wherein said polyester has a number average molecular weight of 2,000 to 20,000.

7. A toner for the development of electrostatic charges according to claim 1, wherein said polyester has an acid value of from 10 to 60.

8. A toner for the development of electrostatic charges according to claim 1, wherein the salicylic acid-metal salt complex is selected from the group consisting of zinc salicylate, chromium salicylate, manganese salicylate, nickel salicylate, cobalt salicylate, cobalt tert-butyl salicylate, chromium 3,5-di-tert-butyl salicylate, and nickel 3,5-di-tert-butyl salicylate.

9. A toner for the development of electrostatic charges, according to claim 1, wherein the amount of the salicylic acid-metal complex is from 0.2 to 4.0% by weight based on the polyester.

* * * * *

UNITED STATES PATENT AND TRADEMARK OFFICE

CERTIFICATE OF CORRECTION

PATENT NO. : 4,535,048

DATED : August 13, 1985

INVENTOR(S) : SUKEJIRO INOUE, ET AL.

It is certified that error appears in the above-identified patent and that said Letters Patent is hereby corrected as shown below:

Column 4, line 37, after "oxypropylene" insert --or oxyethylene--

Column 8, line 23, change "ditert" to --di-tert--.

Signed and Sealed this

*Tenth* Day of *June 1986*

[SEAL]

*Attest:*

DONALD J. QUIGG

*Attesting Officer*

*Commissioner of Patents and Trademarks*